US009599311B2

(12) United States Patent
Benoit et al.

(10) Patent No.: US 9,599,311 B2
(45) Date of Patent: Mar. 21, 2017

(54) INDIRECT LUMINAIRE

(71) Applicant: 3M INNOVATIVE PROPERTIES COMPANY, St. Paul, MN (US)

(72) Inventors: Gilles Jean-Baptiste Benoit, Minneapolis, MN (US); Todd E. Bracher, Brooklyn, NY (US); Gary H. Paulsen, St. Paul, MN (US); Byron E. Trotter, St. Paul, MN (US); Catherine A. Leatherdale, Woodbury, MN (US); Gina M. Albanese, Minneapolis, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 133 days.

(21) Appl. No.: 14/401,733

(22) PCT Filed: May 1, 2013

(86) PCT No.: PCT/US2013/039034
§ 371 (c)(1),
(2) Date: Nov. 17, 2014

(87) PCT Pub. No.: WO2013/173065
PCT Pub. Date: Nov. 21, 2013

(65) Prior Publication Data

US 2015/0138761 A1 May 21, 2015

Related U.S. Application Data

(60) Provisional application No. 61/648,233, filed on May 17, 2012.

(51) Int. Cl.
*F21V 7/06* (2006.01)
*F21V 7/00* (2006.01)
(Continued)

(52) U.S. Cl.
CPC ..... *F21V 7/0008* (2013.01); *F21S 2/005* (2013.01); *F21S 8/033* (2013.01); *F21S 8/04* (2013.01);
(Continued)

(58) Field of Classification Search
CPC ..... F21V 7/0008; F21V 7/0041; F21V 7/09; F21V 7/22; F21V 7/05; F21V 7/0025;
(Continued)

(56) References Cited

U.S. PATENT DOCUMENTS 6,788,463 B2 9/2004 Merrill
2007/0219760 A1 9/2007 Yang
(Continued)

FOREIGN PATENT DOCUMENTS

DE 10344173 4/2005
DE 202011005323 9/2011
EP 1628070 2/2006

OTHER PUBLICATIONS

Cassarly, "Iterative Reflector Design Using a Cumulative Flux Compensation Approach", Proceedings of SPIE, 2010, vol. 7652, pp. 76522L.1-76522L.9.
(Continued)

*Primary Examiner* — Y M Lee
(74) *Attorney, Agent, or Firm* — Philip Y. Dahl

(57) ABSTRACT

A luminaire includes a light source (101), and a first free-form reflector (110) registered with the light source (101) and receiving non-collimated light (102) from the light source (101). A secondary reflector (120) is configured to receive the non-collimated light reflected from the first free-form reflector (110). A second free-form reflector (110) is configured to receive the non-collimated light reflected from the secondary reflector (120). A virtual source reflector (125) is registered with the second free-form reflector (110)
(Continued)

and configured to receive the non-collimated light reflected from the second free-form reflector (110).

16 Claims, 3 Drawing Sheets

(51) Int. Cl.

| | |
|---|---|
| ***F21S 2/00*** | (2016.01) |
| ***F21S 8/00*** | (2006.01) |
| ***F21S 8/04*** | (2006.01) |
| ***F21V 7/09*** | (2006.01) |
| ***F21V 7/22*** | (2006.01) |
| *F21V 7/05* | (2006.01) |
| *F21Y 101/00* | (2016.01) |

(52) U.S. Cl.
CPC ..... *F21V 7/0041* (2013.01); *F21V 7/09* (2013.01); *F21V 7/22* (2013.01); *F21V 7/05* (2013.01); *F21Y 2101/00* (2013.01); *F21Y 2113/13* (2016.08); *F21Y 2115/10* (2016.08)

(58) Field of Classification Search
CPC ..... F21V 7/0066; F21V 7/046; F21S 2/005; F21S 8/033; F21S 8/04; F21Y 2113/005
See application file for complete search history.

(56) References Cited

U.S. PATENT DOCUMENTS

| | | | | |
|---|---|---|---|---|
| 2007/0279907 | A1* | 12/2007 | Goto | B60Q 1/085 362/277 |
| 2007/0297179 | A1* | 12/2007 | Leung | F21K 9/50 362/296.07 |
| 2010/0208467 | A1 | 8/2010 | Dross | |
| 2012/0044694 | A1 | 2/2012 | du Plessis | |

OTHER PUBLICATIONS

Fournier, "Designing freeform reflectors for extended sources", Proceedings of SPIE, 2009, vol. 7423, pp. 742302.1-742302.12.
Fournier, "Fast Freeform Reflector Generation Using Source-Target Maps", Optics Express, 2010, vol. 18, No. 5, pp. 5295-5304.
Fournier, "Freeform reflector design using integrable maps", Proceedings of SPIE, 2010, vol. 7652, pp. 765221.1-765221.10.
Magarill, "Anamorphic Illuminator", Proceedings of SPIE, 2010, vol. 7785, pp. 77850I.1-77850I.6.
Oliker, "A Rigorous Method for Synthesis of Offset Shaped Reflector Antennas", Computing Letters, 2006, vol. 2, No. 1, pp. 29-49.
Yang, "Computer-aided design and optimization of free-form reflectors", Proceedings of SPIE, 2005, vol. 5638, pp. 88-96.
Zhang, "Free-form reflector optimization for general lighting", Optical Engineering, 2010, vol. 49, No. 6, pp. 063003.1-063003.7.
International Search Report for PCT International Application No. PCT/US2013/039034, mailed on Sep. 30, 2013, 5pgs.

* cited by examiner

INDIRECT LUMINAIRE

FIELD

The disclosure relates to indirect luminaires and, in particular, to modular LED illumination articles.

BACKGROUND

Quasi point light sources such as light emitting diodes (i.e., LED), for example, are efficient light sources that are gaining popularity in many types of lighting. One challenge for these light sources is efficiently distributing the relatively concentrated light from the LED. Solid light guides or light boxes are utilized to distribute the light emitted from the LED to a large light emission area. Many of these solid light guides or light boxes include light diffuser elements that reduce the efficiency of the lighting. In addition the light emission area of solid light guides or light boxes are determined by the physical boundaries of the solid light guide or light box and cannot be generally increased without redesigning the system at the manufacturer.

BRIEF SUMMARY

The present disclosure relates to indirect luminaires and, in particular, to modular LED illumination articles. The luminaires direct light from a quasi point source and transport the light in one or more directions while diffusing or scattering light as desired.

In many embodiments, the luminaire includes a light source, and a first free-form reflector registered with the light source and receiving non-collimated light from the light source. A secondary reflector is configured to receive the non-collimated light reflected from the first free-form reflector. A second free-form reflector is configured to receive the non-collimated light reflected from the secondary reflector. A virtual source reflector is registered with the second free-form reflector and configured to receive the non-collimated light reflected from the second free-form reflector and form an image of the light source (hence the expression "virtual source").

In further embodiments, a luminaire includes a light source and a first free-form reflector registered with the light source and receiving non-collimated light from the light source. The first free-form reflector directs light in a first direction and a second direction that is different than the first direction. A first secondary reflector is configured to receive the non-collimated light reflected from the first free-form reflector in the first direction. A second secondary reflector is configured to receive the non-collimated light reflected from the first free-form reflector in the second direction. A second free-form reflector is configured to receive the non-collimated light reflected from the first secondary reflector. A third free-form reflector is configured to receive the non-collimated light reflected from the second secondary reflector. A first virtual source reflector is registered with the second free-form reflector and configured to receive the non-collimated light reflected from the second free-form reflector. A second virtual source reflector is registered with the third free-form reflector and configured to receive the non-collimated light reflected from the third free-form reflector.

The details of one or more embodiments of the disclosure are set forth in the accompanying drawings and the description below. Other features, objects, and advantages of the disclosure will be apparent from the description and drawings, and from the claims.

BRIEF DESCRIPTION OF THE DRAWINGS

The disclosure may be more completely understood in consideration of the following detailed description of various embodiments of the disclosure in connection with the accompanying drawings, in which.

Figure 1:
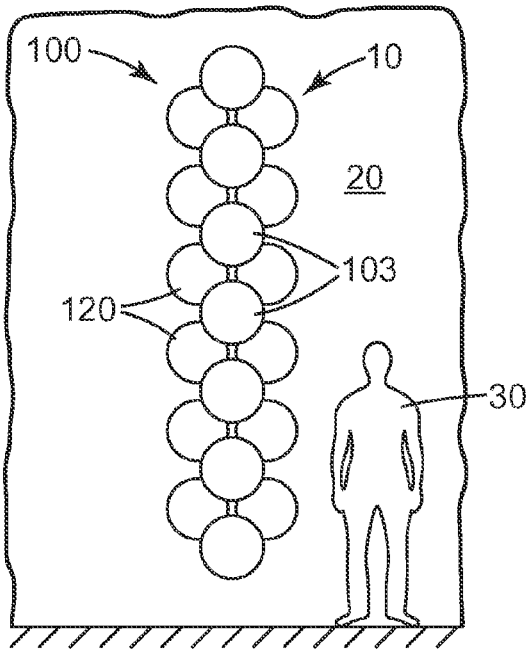
FIG. 1 is a schematic front elevation view of an illustrative luminaire fixed to a wall.

The schematic drawings presented herein are not necessarily to scale. Like numbers used in the figures refer to like components, steps and the like. However, it will be understood that the use of a number to refer to a component in a given figure is not intended to limit the component in another figure labeled with the same number. In addition, the use of different numbers to refer to components is not intended to indicate that the different numbered components cannot be the same or similar.

DETAILED DESCRIPTION

In the following detailed description, reference is made to the accompanying drawings that form a part hereof, and in which are shown by way of illustration several specific embodiments of devices, systems and methods. It is to be understood that other embodiments are contemplated and may be made without departing from the scope or spirit of the present disclosure. The following detailed description, therefore, is not to be taken in a limiting sense.

All scientific and technical terms used herein have meanings commonly used in the art unless otherwise specified. The definitions provided herein are to facilitate understanding of certain terms used frequently herein and are not meant to limit the scope of the present disclosure.

As used in this specification and the appended claims, the singular forms "a", "an", and "the" encompass embodiments having plural referents, unless the content clearly dictates otherwise.

As used in this specification and the appended claims, the term "or" is generally employed in its sense including "and/or" unless the content clearly dictates otherwise.

As used herein, "have", "having", "include", "including", "comprise", "comprising" or the like are used in their open ended sense, and generally mean "including, but not limited to." It will be understood that the terms "consisting of" and "consisting essentially of" are subsumed in the term "comprising," and the like.

Any direction referred to herein, such as "top," "bottom," "left," "right," "upper," "lower," "above," below," and other directions and orientations are described herein for clarity in reference to the figures and are not to be limiting of an actual device or system or use of the device or system. Many of the devices, articles or systems described herein may be used in a number of directions and orientations.

The phrase, "free-form optic" or "free-form reflector" refers to an optic or reflector shaped through computerized design to redistribute a given geometrical optics feed power pattern into a prescribed amplitude aperture distribution. This type of optic or reflector is also known as a non-imaging optic or an anamorphic reflector.

The present disclosure relates to indirect luminaires and, in particular, to modular LED illumination articles. The luminaires direct light from a quasi point source and transport the light in one or more directions while diffusing or scattering light as desired. The illumination apparatus efficiently transports light away from the concentrated light source, such as an LED or plasma source and distributes it over a large area such as a wall or ceiling for example. The illumination apparatus can transport light away from the concentrated light source in one or more directions. The illumination apparatus can be formed in any linear shape or configuration. The illumination apparatus utilizes free-form reflectors and highly efficient reflective material to efficiently direct and transport light from the point source to a large area. The illumination apparatus can utilize one physical LED to create N virtual (imaged) LEDs whose individual brightness is on the order of 1/N that of the physical LED. This is useful because although high brightness LEDs can help reduce system complexity and offer a low-cost solution they are difficult to design around without sacrificing efficiency and/or losing their point-source characteristic. This disclosure offers the advantages of multiple low-brightness LEDs from a design standpoint while offering all the practicality and cost advantage of a single high brightness LED (e.g., transport and spreading of the high intensity light source to a large area). Each reflective element of the illumination apparatus has its own transport and "spreading" function of distributing the light on the wall and in the room. While the present disclosure is not so limited, an appreciation of various aspects of the disclosure will be gained through a discussion of the examples provided below.

Figure 2:
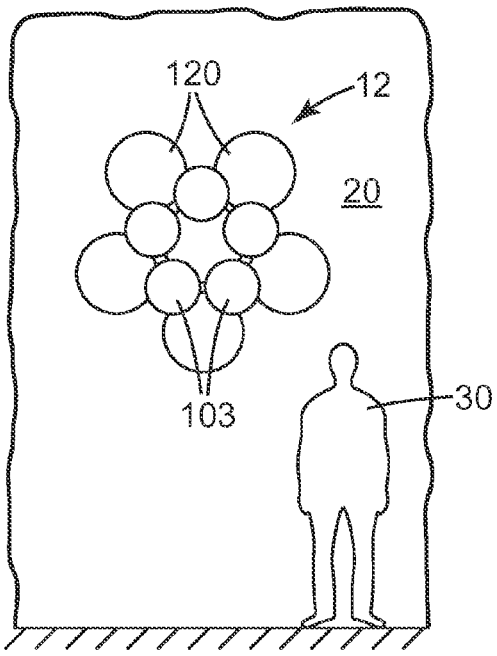
FIG. 2 is a schematic front elevation view of another illustrative luminaire fixed to a wall.

FIG. 1 is a schematic front elevation view of an illustrative luminaire 10 fixed to a wall. The luminaire 10 is a straight linear element that is shown in a vertical configuration relative to the wall 20 and the viewer 30. FIG. 2 is a schematic front elevation view of another illustrative luminaire 12 fixed to a wall. The luminaire 12 is a circular linear element relative to the wall 20 and the viewer 30. Both luminaires 10 and 12 include free-form reflectors (hidden by the covers 103) and secondary reflectors 120 that cooperate to direct and transport light from a point light source to a large area of the wall 20. Both luminaires 10 and 12 include decorative covers 103. The cover pieces 103 can add a further decorative element to the luminaire 10 and 12. The decorative covers 103 can also act to further attenuate any light that directly passes from the light source or the virtual light source (described below) through the free-form reflector in a direction normal to the plane of transport. While two configurations are illustrated, the luminaire can be configured in any desired manner. The modularity of the components that form the luminaire, described further herein, provides the flexibility to design and configure the luminaire to achieve the desired result.

Figure 3:
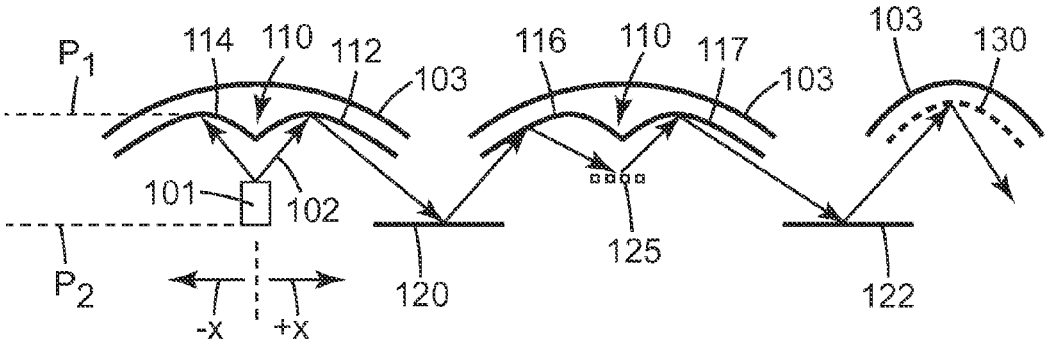
FIG. 3 is a schematic side view of an illustrative luminaire.
Figure 5:
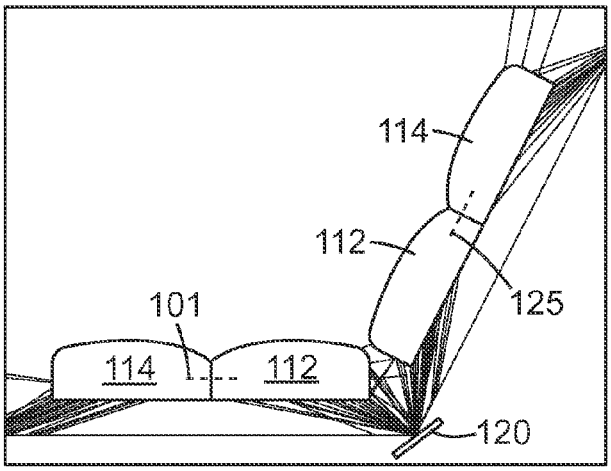
FIG. 5 is a schematic side view of two 2-fold free-form reflectors reflecting light out-of-plane.

FIG. 3 is a schematic side view of an illustrative luminaire 100. For ease of illustration, the light path for only one side (the +x direction) of a 2-fold free-form reflector is shown. It is understood that a mirror image of the reflecting elements are in the −x direction. In many embodiments, the luminaire directs and transports light along a plane or between a first plane $P_1$ and a second plane $P_2$. In other embodiments the luminaire directs and transports light in out-of-plane directions as illustrated in FIG. 5.

The reflective surfaces described herein can be formed of a highly reflective material, such as at least about 95% efficient or at least about 99% efficient for light incident at any angle. Illustrative reflective multilayer polymeric film is described in U.S. Pat. No. 6,788,463 and is incorporated by reference herein. These reflective multilayer polymeric films are thermoformable and can be utilized to create the complex reflective curvatures that form the free-form optic or reflectors. The free-form reflector may have primarily specular reflectivity or be partially diffuse. The specular reflectivity in general is greater than 50% of the total reflective coefficient. The free-form reflector may be selected such that the light that is transmitted through the free-form reflector has the same spectrum as the light that is transported, or it may be different. Other materials could also be used, such as vacuum deposited thin metal films (for example silver) on polymeric substrates.

The illustrative luminaire 100 includes a light source 101 and a first free-form reflector 110 registered with the light source 101 and receiving non-collimated light 102 from the light source 101. The light source 101 can be any useful concentrated point light source or quasi point light source. In many embodiments the light source 101 is a light emitting diode. The free-form reflector 110 directs light in the +x direction (as shown) and in the −x direction. The free-form reflector 110 is large enough to capture or redirect a majority of the non-collimated light (Lambertian or isotropic emission) emitted by the light source 101. In many embodiments the free-form reflector 110 has a minimum focal length and a minimum focal parameter that is at least 5 times the length or width (whichever is larger) forming the light emission surface area of the light source 101. As described herein, the minimum focal length is the minimum distance between the two foci of any conic subsection of the reflector while the minimum focal parameter is the minimum distance from the focus (source center position) to the conic section directix of any conic subsection of the reflector. One free-form reflector usually has multiple focal lengths and focal parameters. The shape of the free-form reflector needed to achieve a prescribed amplitude aperture distribution can be calculated using algorithms known in the art such as those demonstrated by Prof. Vladimir Officer in December 2001 ("A Rigorous Method for Synthesis of Offset Shaped Reflector Antennas", Journal of Computational Methods in Sciences and Engineering) and published in 2006.

A secondary reflector 120 is configured to receive the non-collimated light 102 reflected from surface 112 of the first free-form reflector 110. Non-collimated light 102 is reflected from surface 114 first free-form reflector 110 in the −x direction. In many embodiments the secondary reflector 120 is a planar surface. A second free-form reflector 110 is configured to receive the non-collimated light reflected from the secondary reflector 120. The second free-form reflector 110 includes light receiving surfaces 116 and 117. A virtual source reflector 125 (i.e., a reflector positioned at the focal length of the free-form reflector where an image of the physical LED is formed) is registered with the second free-form reflector 110 and is configured to receive the non-collimated light reflected from the second free-form reflector surface 116 and reflecting this light to the second free-form reflector surface 117. The virtual source reflector 125 can be fully light reflective or partially light transmissive, as desired. The virtual source reflector 125 may have fully specular or partially diffuse reflecting properties as desired.

In many embodiments the second free-form reflector 110 is configured to receive the non-collimated light reflected from the virtual source reflector 125 (at surface 117) and the second free-form reflector surface 117 is configured to scatter light. In many embodiments, the second free-form reflector surface 117 is configured to further transport light to a second secondary reflector 122 configured to receive the non-collimated light reflected from the second free-form reflector surface 117. In further embodiments, the second free-form reflector surface 117 is configured to both scatter light and transport light to a second secondary reflector 122, allowing for a controlled or designed light leakage onto an adjacent surface such as a wall or ceiling.

In further embodiments, the luminaire 100 includes a diffusing reflector 130 configured to receive the non-collimated light reflected from the second secondary reflector 122. The diffusing reflector 130 spreads out the received light onto an adjacent surface such as a wall or ceiling. The diffusing reflector 130 can also be a free-form reflector designed to precisely control the illuminance distribution on the wall to create a desired aesthetic. Additional free-form reflectors 110 and virtual source reflectors 125 and secondary reflectors 120 can be utilized to transport light a further distance away from the light source 101. Cover pieces or elements 103 can be disposed over the free-form reflectors 110 or any of the other elements of the free-form reflectors 110 as desired.

As described above, the luminaire 100 can include the elements described above in the same configuration along the −x direction. For example, the luminaire can include a light source and a first free-form reflector registered with the light source and receiving non-collimated light from the light source. The first free-form reflector directs light in a first direction and a second direction that is different than the first direction. A first secondary reflector is configured to receive the non-collimated light reflected from the first free-form reflector in the first direction. A second secondary reflector is configured to receive the non-collimated light reflected from the first free-form reflector in the second direction. A second free-form reflector is configured to receive the non-collimated light reflected from the first secondary reflector. A third free-form reflector is configured to receive the non-collimated light reflected from the second secondary reflector. A first virtual source reflector is registered with the second free-form reflector and configured to receive the non-collimated light reflected from the second free-form reflector. A second virtual source reflector is registered with the third free-form reflector and configured to receive the non-collimated light reflected from the third free-form reflector.

Figure 4:
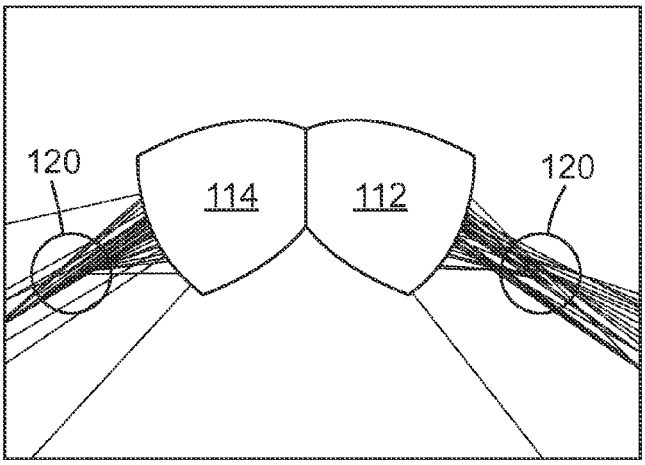
FIG. 4 is a front elevation view of a 2-fold free-form reflector.

FIG. 4 is a front elevation view of a 2-fold free-form reflector. The free-form reflector is registered with the light source (below the free-form reflector) and receives non-collimated light from the light source. This light is reflected in a first direction via first reflecting surface 112 to a secondary reflector 120 and a second direction via second reflecting surface 114 to a secondary reflector 120.

FIG. 5 is a schematic side view of two 2-fold free-form reflectors reflecting light out-of-plane. The first free-form reflector is registered with the light source 101 and receives non-collimated light from the light source 101. Each free-form reflector includes a light reflecting surface 112 and a light reflecting surface 114. A secondary reflector 120 is configured to receive the non-collimated light reflected from the first free-form reflector surface 112. The reflector surface 112 of the second free-from reflector receives light from secondary reflector 120. A virtual source reflector 125 (i.e., a reflector positioned at the focal length of the free-form reflector where an image of the physical LED 101 is formed) is registered with the second free-form reflector and is configured to receive the non-collimated light reflected from the second free-form reflector surface 112 and reflecting this light to the second free-form reflector surface 114. Light is directed in two different and out-of-plane directions from the light source 101.

Figure 6:
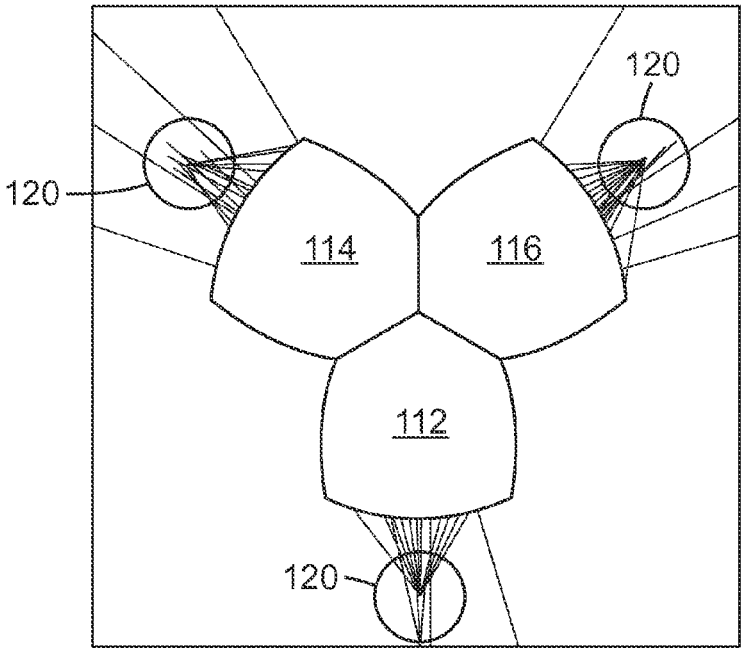
FIG. 6 is a front elevation view of a 3-fold free-form reflector.
Figure 7:
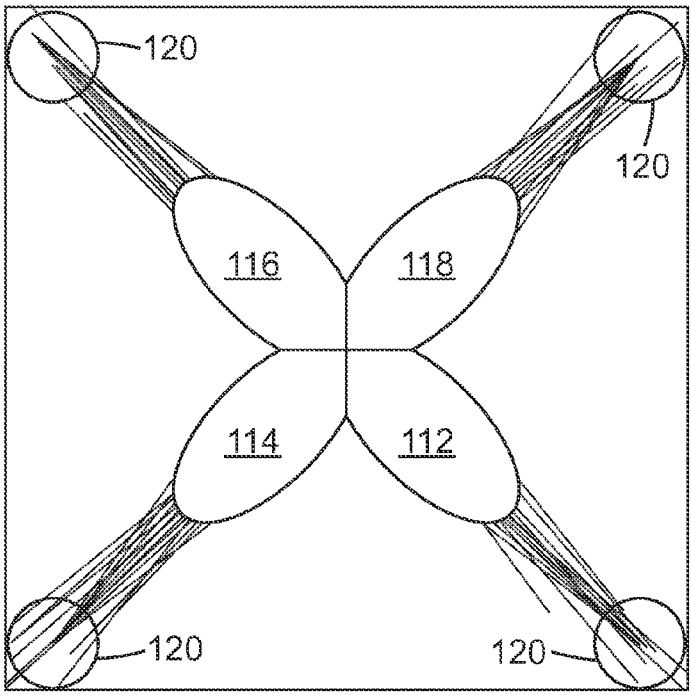
FIG. 7 is a front elevation view of a 4-fold free-form reflector.

FIG. 6 is a front elevation view of a 3-fold free-form reflector. This reflector has three light reflection surfaces 112, 114, and 116 and directs light in three different directions. FIG. 7 is a front elevation view of a 4-fold free-form reflector luminaire with light ray trace. This free-form reflector has four light reflection surfaces 112, 114, 116, and 118 and directs light in four different directions. The luminaire of FIG. 7 illustrates four secondary reflectors 120 directing and transporting light to two further free-form reflectors. Free-form reflectors with higher symmetry are also contemplated and may also be useful as the luminous output from a single LED continues to increase. In addition, free-form reflectors can have no symmetry (e.g., have four arbitrary directions), as desired.

In some cases it may be desirable to add additional cover pieces 103 over the free-form reflector. The cover pieces may add a further decorative element to the luminaire that may be desirable. They can also act to further attenuate any light that directly passes from the light source or the virtual light source through the free-form reflector in a direction normal to the plane of transport.

In some embodiments, the luminaire can include a light source having a first spectral output and a second light source having a second spectral output different from the first light source. The first and second light sources are registered under different free-form reflectors but are connected by an optical path that includes at least one common virtual source reflector. For example one light source could emit red light and the other light source could emit blue light. Light could be transported from the red light source to the blue light source and through a series of reflections by free-form reflectors, secondary reflectors, and virtual source reflectors as described herein. In the same manner, blue light could be transported back towards the red light source. The emitted spectrum from the luminaire would then appear to gradually change from primarily red at one end to primarily blue at the other and a mixed color (purple) in between.

Thus, embodiments of INDIRECT LUMINAIRE are disclosed. One skilled in the art will appreciate that the optical films and film articles described herein can be practiced with embodiments other than those disclosed. The disclosed embodiments are presented for purposes of illustration and not limitation.

What is claimed is:

1. A luminaire, comprising:

a light source;

a first free-form reflector registered with the light source and receiving non-collimated light from the light source;

a secondary reflector configured to receive the non-collimated light reflected from the first free-form reflector;

a second free-form reflector configured to receive the non-collimated light reflected from the secondary reflector; and a virtual source reflector registered with the second free-form reflector and configured to receive the non-collimated light reflected from the second free-form reflector; wherein the virtual source reflector is partially diffusely reflective.

2. The luminaire of claim 1, wherein the second free-form reflector is configured to receive the non-collimated light reflected from the virtual source reflector.

3. The luminaire of claim 2, wherein the second free-form reflector is configured to scatter light.

4. A luminaire, comprising:

a light source;

a first free-form reflector registered with the light source and receiving non-collimated light from the light source;

a secondary reflector configured to receive the non-collimated light reflected from the first free-form reflector;

a second free-form reflector configured to receive the non-collimated light reflected from the secondary reflector; and a virtual source reflector registered with the second free-form reflector and configured to receive the non-collimated light reflected from the second free-form reflector; further comprising a second secondary reflector configured to receive the non-collimated light reflected from the second free-form reflector.

5. The luminaire of claim 4, further comprising a diffusing reflector configured to receive the non-collimated light reflected from the second secondary reflector.

6. A luminaire, comprising:

a light source;

a first free-form reflector registered with the light source and receiving non-collimated light from the light source, the first free-form reflector directing light in a first direction and a second direction being different than the first direction;

a first secondary reflector configured to receive the non-collimated light reflected from the first free-form reflector in the first direction;

a second secondary reflector configured to receive the non-collimated light reflected from the first free-form reflector in the second direction;

a second free-form reflector configured to receive the non-collimated light reflected from the first secondary reflector;

a third free-form reflector configured to receive the non-collimated light reflected from the second secondary reflector;

a first virtual source reflector registered with the second free-form reflector and configured to receive the non-collimated light reflected from the second free-form reflector; and a second virtual source reflector registered with the third free-form reflector and configured to receive the non-collimated light reflected from the third free-form reflector.

7. The luminaire of claim 6, wherein the first free-form reflector directing light in a third direction being different than the first direction and the second direction.

8. The luminaire of claim 7, wherein the first free-form reflector directing light in a fourth direction being different than the first direction and the second direction and the third direction.

9. The luminaire of claim 6, wherein the non-collimated light is transported away from the light source between a first plane and a second plane.

10. The luminaire of claim 6, wherein the first or second virtual source reflector is partially diffusely reflective.

11. The luminaire of claim 6, wherein the second free-form reflector is configured to receive the non-collimated light reflected from the first virtual source reflector and the third free-form reflector is configured to receive the non-collimated light reflected from the second virtual source reflector.

12. The luminaire of claim 6, wherein the second or third free-form reflector is configured to scatter or diffuse light.

13. The luminaire of claim 6, wherein a minimum distance between the first free-form reflector and a center of the light source is at least 5 times a length of the light source emission surface.

14. The luminaire of claim 6, wherein the first free-form reflector comprises a plurality of polymeric layers and having a light reflection efficiency of at least 95%.

15. The luminaire of claim 6, wherein the light source is a light emitting diode.

16. A luminaire, comprising:

a first light source having a first spectral output and a second light source having a second spectral output different from the first spectral output;

a first free-form reflector registered with the first light source and receiving non-collimated light from the first light source;

a second free-form reflector registered with the second light source and receiving non-collimated light from the second light source;

a first secondary reflector configured to receive non-collimated light reflected from the first free-form reflector;

a second secondary reflector configured to receive non-collimated light reflected from the second free-form reflector;

a third free-form reflector configured to receive non-collimated light reflected from one or both of the first and second secondary reflectors; and a virtual source reflector registered with the third free-form reflector and configured to receive the non-collimated light reflected from the third free-form reflector.

* * * * *